US006331085B1

(12) United States Patent
Schrepf et al.

(10) Patent No.: US 6,331,085 B1
(45) Date of Patent: Dec. 18, 2001

(54) CONTAINER-APPLICATOR SYSTEM FOR MATERIAL FOR THE SKIN

(75) Inventors: Volker Schrepf, East Islip; Michael Malvar, Oceanside, both of NY (US)

(73) Assignee: Henlopen Manufacturing Co., Inc., Melville, NY (US)

( * ) Notice: Subject to any disclaimer, the term of this patent is extended or adjusted under 35 U.S.C. 154(b) by 0 days.

(21) Appl. No.: 09/636,017

(22) Filed: Aug. 10, 2000

Related U.S. Application Data

(60) Provisional application No. 60/151,526, filed on Aug. 30, 1999.

(51) Int. Cl.[7] ..... B43M 11/00

(52) U.S. Cl. ..... 401/128; 401/126; 401/122

(58) Field of Search ..... 401/126, 128, 401/121, 122, 118, 119, 127, 130

(56) References Cited

U.S. PATENT DOCUMENTS

| | | | | |
|---|---|---|---|---|
| 1,652,585 | * | 12/1927 | Schreiber | 401/128 |
| 2,201,467 | | 5/1940 | Bloom | 132/79 |
| 2,264,482 | | 12/1941 | Ridner, Sr. et al. | 132/79 |
| 2,442,503 | | 6/1948 | Melnikoff | 132/88.7 |
| 2,604,105 | | 7/1952 | Kruck | 132/88.7 |
| 4,437,477 | * | 3/1984 | Gueret | 401/128 |
| 4,974,980 | * | 12/1990 | Gueret | 401/128 |
| 5,123,431 | | 6/1992 | Wilson | 132/320 |
| 5,509,742 | | 4/1996 | Balzarini | 401/17 |
| 5,542,144 | | 8/1996 | Forsline | 15/245.1 |
| 5,573,340 | | 11/1996 | Gueret | 401/126 |

* cited by examiner

*Primary Examiner*—David J. Walczak
(74) *Attorney, Agent, or Firm*—Cooper & Dunham LLP

(57) ABSTRACT

A container-applicator system for cosmetic or like materials such as creams, powders, liquids and gels. The applicator of the system has an elongated tip for metered application of the material, located at the distal end of a stem which is carried by a cap so as to be inserted into and withdrawn from the mouth of a container of a cosmetic product to be applied. The tip is a molded elastomer element having a distal end formed with a shallow cup, which may be oriented at an oblique angle to the stem. A flexible wiper, mounted in the container mouth, removes excess material from the cup as the applicator is withdrawn from the container.

10 Claims, 8 Drawing Sheets

CONTAINER-APPLICATOR SYSTEM FOR MATERIAL FOR THE SKIN

CROSS-REFERENCE TO RELATED APPLICATION

This application claims the benefit of U.S. provisional application No. 60/151,526, filed Aug. 30, 1999.

BACKGROUND OF THE INVENTION

This invention relates to container-applicator systems for materials which are applied to the human skin. In one important specific aspect, to which detailed reference will be made below for purposes of illustration, the invention is particularly directed to container-applicator systems for cosmetics such as creams, powders, liquids and gels. However, in a broader sense the invention may also be embodied in systems for applying other types of materials, such as medicinal ointments or the like, to the skin.

Many cosmetic materials that, unlike lipstick bullets or eyebrow pencils, are flowable or otherwise non-self-sustaining in shape, are packaged and sold in a container which holds a body of the material and from which the material is transported and applied to a user's skin by an applicator device. Commonly, the applicator is provided at the end of a stem carried by a cap which seats on and closes the mouth or opening of the container, the applicator being immersed in the contained body of cosmetic material when the cap is in the container-closing position. The cap serves as a handle for the user when the applicator, bearing a quantity of the cosmetic material, is withdrawn from the container and applied to the skin.

Examples of cosmetic applicators known and employed in present-day commercial practice include twisted-in-wire brushes with radially protruding, relatively short, stiff bristles; brushes with relatively long, soft flexible bristles anchored at one end; swabs; and flocked tips. In some instances, a flexible elastomeric wiper is mounted in the container opening so as to engage the applicator as the applicator is withdrawn through the opening, for removing excess cosmetic material that may be carried by the applicator from the body of material within the container.

While such applicators are generally satisfactory, they have various drawbacks including the possibility that components such as fibers or adhesive may become detached and incorporated in the cosmetic applied to the skin, sometimes causing an allergic reaction. Also, the design of these known devices may be more or less difficult to tailor to particular application requirements. In addition, while the use of a wiper may prevent grossly excessive quantities of cosmetic material from being transported and applied to the skin, the known applicators do not generally afford the ability to achieve precise metering of individual application quantities.

SUMMARY OF THE INVENTION

The present invention broadly contemplates the provision of a container-applicator system for material to be applied to the human skin, comprising, in combination, a container for holding a body of the material, the container having an opening; a flexible wiper mounted in the opening; and an applicator insertable into and withdrawable from the container through the opening for transporting a quantity of the material from the container and applying the transported quantity of material to a user's skin, the wiper engaging the applicator to remove excess amounts of material therefrom as the applicator is withdrawn through the opening, the applicator comprising a generally cylindrical elastomeric tip with a long axis, the tip including a distal end portion having a distal extremity with at least one material-holding concavity formed therein and having a rim.

As a further particular feature of the invention, in important embodiments thereof, the distal extremity of the distal end portion of the applicator tip has a single, cup-shaped, material-holding concavity formed therein, the concavity having a rim.

In some currently preferred embodiments of the invention, the rim of the concavity lies substantially in a plane at an oblique angle to the long axis of the applicator tip. As used with such a tip, the wiper is a flexible annular member which engages the rim of the concavity as the applicator tip is withdrawn through the opening so as to remove any excess of the material projecting from the concavity, whereby the concavity and the wiper cooperatively meter the amount of the material transported from the container by each withdrawal of the applicator therefrom.

The invention, in addition, broadly embraces embodiments in which the plane of the concavity rim is at an angle of anywhere from 0° to 90° to the long axis of the applicator tip, as well as embodiments in which the concavity rim does not lie substantially in a plane, and embodiments in which there are a plurality of concavities and/or in which the concavity or concavities are, for example, elongated rather than cup-shaped.

Also, in currently preferred embodiments, the applicator tip has a proximal shank portion formed integrally with the distal end portion, and the system further includes a stem having a distal opening in which the shank portion is fixedly inserted, advantageously or conveniently by staking. The container commonly has a neck portion in which the opening is formed, and the applicator further includes a cap seatable on the neck, a proximal end of the stem being secured to the cap such that the stem extends from the cap through the opening and into the container when the cap is seated on the neck portion.

By appropriate selection of material properties, the applicator tip may be made sufficiently flexible to be soft and to deform readily under manual pressure when applied against a user's skin, thereby to aid in delivering and/or spreading a cosmetic or other product.

In some instances, the applicator tip is formed by bi-injection molding with elastomers of respectively different durometer such that the shank portion of the applicator tip has a higher durometer than the distal end portion. This difference in durometer between shank portion and distal end portion enables optimization of the properties of the two portions for their respective functions of mounting in the stem and flexibly applying material to the skin. One such bi-injection molded tip has a higher-durometer shank portion formed with a distally projecting core portion surrounded by the lower-durometer distal end portion so that the applicator tip is externally soft to the touch but is stiffened by the core to enhance precision of application.

Container-applicator systems of the present invention can be used for the application to the human skin of a wide variety of materials which are more or less non-self-sustaining in shape, including, without limitation, creams, powders, liquid and gels. Non-limiting examples of such materials are cosmetics and medicinal ointments.

The design of the applicator tip incorporated in the system of the invention can readily be tailored for particular applications. Thus, the cup depth and profile can be selected to provide a metered amount of product for a specific application, as required, with the profile being varied to suit the required application characteristics of the product to be applied, and the cup depth also being varied to any depth required. Again, the elastomer used can be varied, e.g. in durometer, to match the requirements of application while remaining soft and comfortable against the skin; in addition, the surface texture can be varied to match the requirements of the product being applied (matte, smooth, grained, etc.). Bi-injection molding of the contacting distal surface and proximal shank portion can be employed to produce an applicator of varying durometer to better exploit the materials being used (soft tip/stiff shank portion, etc.). It will be understood that with bi-injection molding, the applicator tip can be made with more than one material, i.e., using multiple materials in different areas of the tip.

The application surface angle (angle of the plane of the concavity rim to the long axis of the applicator tip) can be varied as well, to match the application requirements of the product, the ergonomic requirements of the user, or both. This angle, as noted above, can be varied between 0° and 90° (perpendicular) relative to the long axis of the applicator tip.

The applicator contains no fibers, adhesives or other topically applied materials that may interact negatively with the product being applied, or may produce an allergic reaction in the user. The applicator may be molded of elastomer resins containing antibacterial additives if desired.

The applicator tip of the system of the invention provides the same flexibility of application of a variety of brush type and flock type applicators while allowing a high degree of design flexibility with regard to geometry, surface texture, and application characteristics within a single homogeneous unit.

Further features and advantages of the invention will be apparent from the detailed description hereinbelow set forth, together with the accompanying drawings.

DETAILED DESCRIPTION

Figure 1:
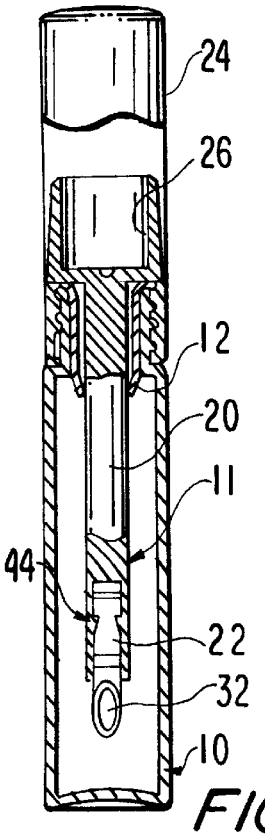
FIG. 1 is a sectional elevational view of a container-applicator system for a cosmetic material, embodying the present invention in a particular form.
Figure 2:
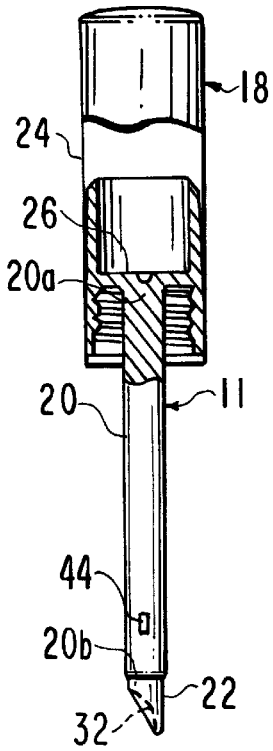
FIG. 2 is a similar view of the cap and applicator of the system of FIG. 1.
Figure 3:
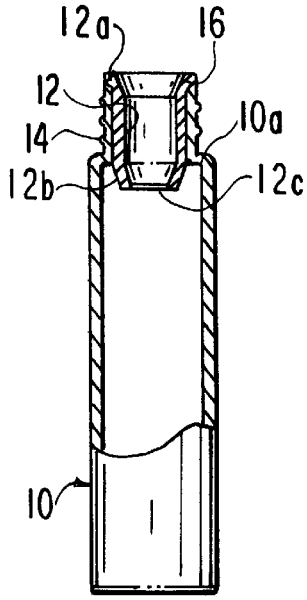
FIG. 3 is a similar view of the container and wiper of the system of FIG. 1.
Figure 5:
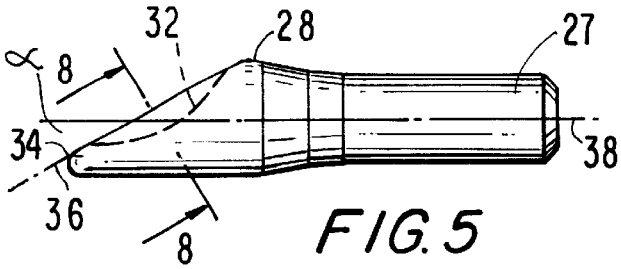
FIGS. 4–7 are, respectively, front elevational, side elevational, distal end, and proximal end enlarged views of the applicator tip of the system of FIG. 1.
Figure 7:
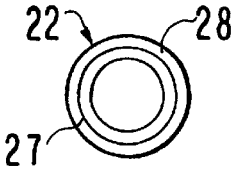
Figure 8:
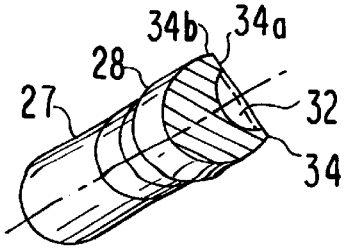
FIG. 8 is a perspective view of the same tip, sectioned as along the plane 8—8 of FIG. 5.
Figure 6:
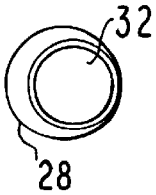
Figure 4:
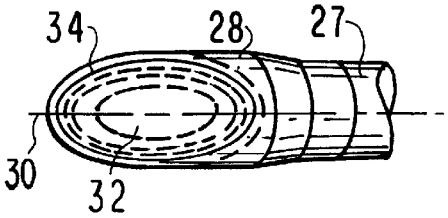
Figure 9:
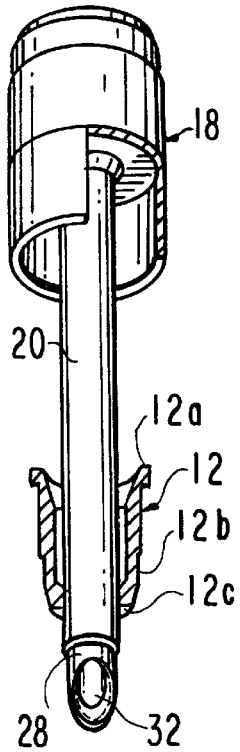
FIGS. 9–11 are perspective views, partly in section, of the wiper and applicator of the system of FIG. 1, respectively illustrating three successive stages in the passage of the applicator through the wiper as the applicator is withdrawn from the container.
Figure 10:
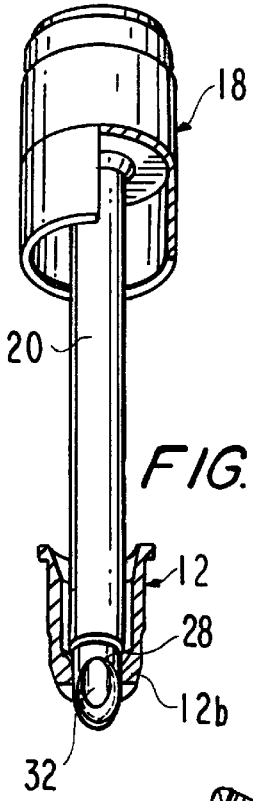
Figure 11:
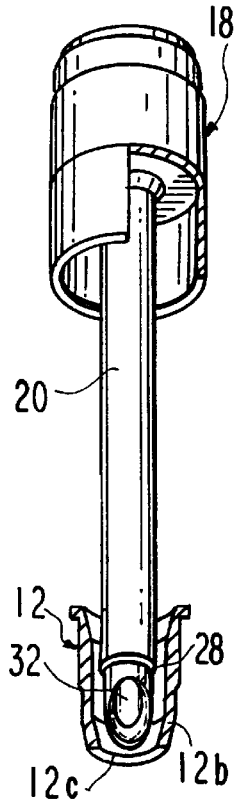
Figure 12:
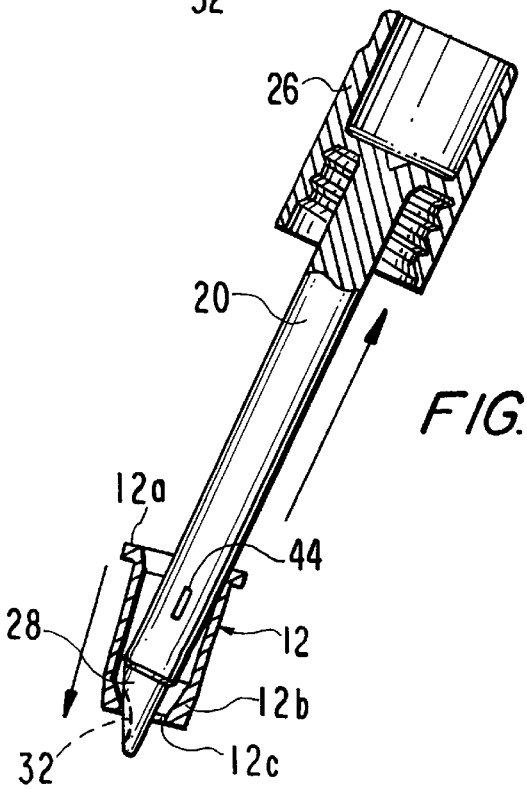
FIG. 12 is a sectional elevational view of the wiper and applicator in the same relative positions as in FIG. 10.

The illustrative embodiment of the invention shown in FIGS. 1–3 is a container-applicator system for a cosmetic or other flowable material for skin application (product material) in the form of a liquid, cream or gel. Specific examples of such product materials include, without limitation, concealers, eye shadows, mascaras, lip treatment or lip color products, skin treatment or skin color products, nail treatment products, etc. The system of FIGS. 1–3 broadly comprises a container 10, an applicator 11 and a wiper 12.

The container 10 is an elongated, rigid, generally cylindrical molded plastic receptacle, e.g. of a type conventionally employed to package cosmetics, for holding a body of the product material (not shown). It has an upper end formed as an externally threaded neck 14 defining a mouth or opening 16 through which it is initially filled with the product material, and from which quantities of the contained product material are withdrawn for application to a user's skin.

The applicator 11 includes a cap 18, a stem 20 and an applicator tip 22. The cap 18, also of generally cylindrical configuration, is removably seated on the neck 14 to close the opening and to prevent drying, leakage or contamination of the product material within the container. As shown, the cap may be constituted of an outer decorative sheath 24 fitted over and adhered to an inner rigid molded plastic member 26 which bears an internal thread for engaging the thread of the neck.

Molded integrally with the member 26 (so as to be secured at its proximal end 20*a* to the cap), and projecting inwardly therefrom in coaxial relation to the cap thread, the stem 20 is a rigid, axially rectilinear rod which extends downwardly into the container interior when the cap is threaded on the neck 14. At its distal end 20*b*, the stem bears the applicator tip 22, hereinafter further described, which serves to transport a quantity of the product material from the container 10 and apply it to a user's skin when the cap is unscrewed from the neck 14 and manipulated (as a handle for the applicator) to withdraw the stem and applicator tip from the container and to deposit and spread or smooth the transported material at a desired location on the skin. The combined length of the stem and applicator tip is sufficient to reach almost to the bottom of the container interior so that the tip is immersed in the contained body of product material, and thus able to transport the product material from the container, until the container is virtually empty.

The wiper 12 is a downwardly tapering, resiliently flexible, molded plastic sheath open at both its upper and lower ends and mounted within the neck 14 of the container 10 so that its upper flange 12*a* seats on, and is secured by press-fitting or snap-fitting in, the upper rim of the neck. The annular lower lip 12*b* of the wiper defines a metering orifice 12*c*, and extends downwardly into the container for a short distance below the shoulder 1*a* at the lower end of the neck where the container interior widens out, so as to be free to expand elastically to enable passage of the applicator stem 20 and tip 22 therethrough. Typically, the wiper is fabricated of a substance such as low density polyethylene (LDPE), silicone, Buna, nitrile, polypropylene, or a blend of two or more of such materials; the blend can also include additives.

When the cap is threaded on the neck, the stem 20 extends downwardly through the metering orifice 12*c*, being surrounded by the wiper. As the stem and applicator tip are withdrawn through the orifice 12*c* after the cap is unscrewed, the lip 12*b* elastically engages the stem and applicator tip in succession, thereby removing excess product material from the applicator, as explained below. The composition of the wiper is selected to provide a desired degree of elastic flexibility; this property, and also the metering orifice dimension and the wall thickness of the wiper, together determine the amount of product material that the wiper leaves on the applicator tip as the applicator is withdrawn through the orifice.

Important features of the present invention reside in the combination, with the above-described wiper and container, of the structure and characteristics of the applicator tip 22. In the embodiment of FIGS. 1–3, as best seen in FIGS. 4–8, the tip 22 is a unitary, integrally molded, axially rectilinear element of generally cylindrical configuration (although its diameter may vary along its length), fabricated of elastomer. It has a cylindrical proximal shank portion 27 which (as further described below) serves to mount the tip 22 in the stem 20 coaxially therewith, and a distal end portion 28 having a distal extremity 30 with a cup-shaped concavity 32 formed therein to constitute a reservoir for holding and carrying a quantity of the product material from the body in the container for application to a facial or other skin area of a user. The concavity is completely surrounded by a continuous, uninterrupted annular rim 34 lying in a plane 36 (FIG. 5) which is oriented at an angle $\alpha$ of at least about 5° to the long axis 38 of the applicator tip. Preferably, in at least many instances, the angle $\alpha$ is an oblique angle; in the embodiment of FIGS. 5–8 the angle $\alpha$ is 300.

As one non-limiting specific example of dimensions, the applicator tip of FIGS. 4–8 has a shank diameter of 0.125 inch, a maximum distal end portion diameter of 0.150 inch, and an overall length of 0.625 inch. The radius of the cup-shaped concavity 32 of this tip in the plane of the drawing in FIG. 5 (a plane containing the long axis 38 of the applicator tip) is 0.206 inch while the radius of the same concavity in the transverse plane 8—8 of FIG. 5 (the plane of the section in FIG. 8) is 0.055 inch. The rim 34 is rounded, for assured comfort to the user, having an inner radius (FIG. 8) at 34*a* of 0.010 inch along the entire edge of the cup and an outer radius at 34*b* of 0.015 inch, also along the entire edge of the cup.

The material of which this particular applicator tip is made is silicone, having a durometer of 45/50. More generally, suitable materials for the applicator tip include (without limitation) silicone, Santoprene, nylon, POM, LDPE, high density polyethylene (HDPE), polypropylene, Buna, nitrile, and EDPM, or blends of two or more of these materials with or without lubricant and/or other additive. The durometer (stiffness or softness) of the distal end portion of the applicator tip, which engages the user's skin during application of the product material, is determined by the material selected for the tip or at least the distal end portion thereof (where different portions of the tip are formed of different materials as by bi-injection molding, described below); desirably, for many purposes, the distal end portion including the rim 34 is of sufficiently low durometer to conform to the application (skin) surface, remaining soft and comfortable against the skin while the product material is being applied. The rim 34 serves as an application surface for spreading the product material (conveyed in the concavity 32) on the skin; this application surface is, as shown, obliquely angled for ergonomically advantageous positioning during application.

In addition, the material of which the tip 22 is made is chosen to be hypoallergenic and to be chemically nonreactive with the product material being applied.

As will now be understood, in the illustrated embodiment of the container-applicator system of the invention, the container 10 holds the product material to be applied, and the applicator 11 is used to retrieve the product material. The stem 20 is used to insert and remove the applicator tip 22 from the bottom of the container, while the wiper 12 wipes excess product material from the stem and applicator as they are removed from the container.

FIGS. 9–15 show the applicator tip and stem assembly passing through the wiper. The orifice 12*c* at the smaller (lower) end of the wiper must be sufficiently elastically flexible to wrap around (snugly engage) the outer diameter of the stem 20 without preventing insertion and removal of the stem during product retrieval. The size, wall thickness and flexibility of the orifice are varied depending on the metered quantity or dosage of product material desired to be removed by the applicator tip during each individual withdrawal from the container. The size and shape of the applicator tip, in particular the dimensions and configuration of the concavity 32, also contribute to the determination of this metered amount or dosage.

Figure 13:
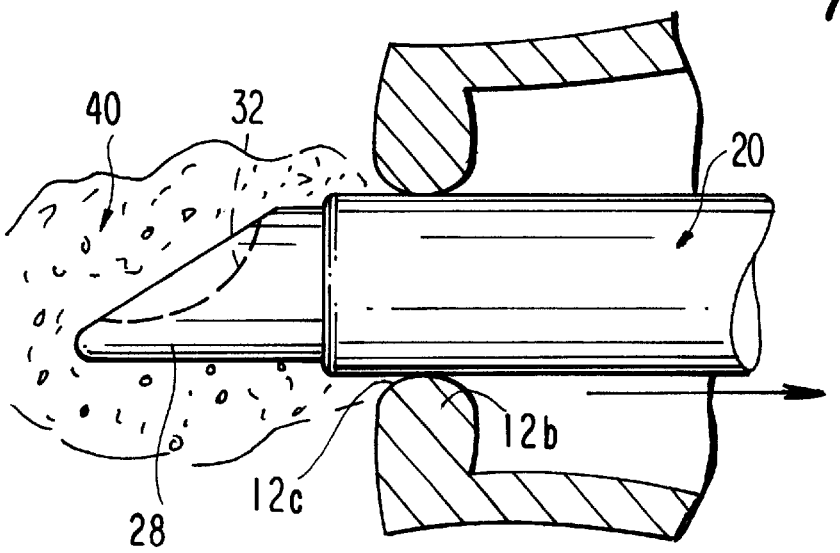
FIGS. 13–15 are enlarged fragmentary side sectional views of the applicator tip and wiper at the same three stages as in FIGS. 9–11, respectively, as the applicator tip is withdrawn from the container through the wiper.
Figure 14:
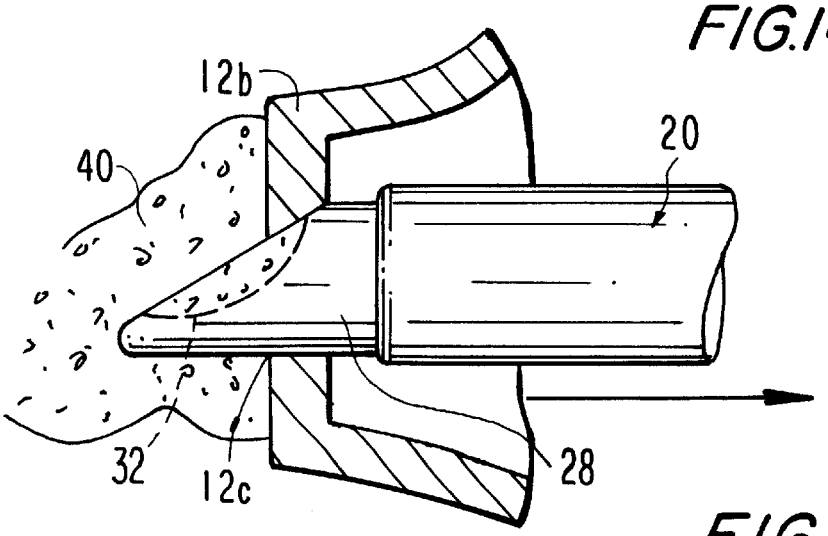
Figure 15:
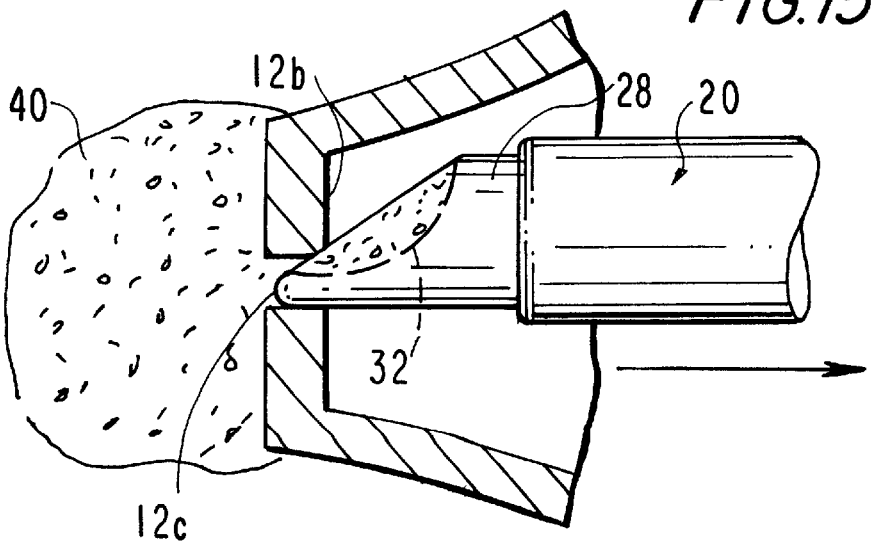
Figure 19:
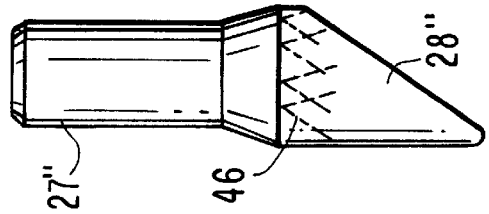
FIGS. 18 and 19 are side elevational views of two different bi-injection molded applicator tips usable in the FIG. 1 system.

The cooperation of the wiper and applicator tip in metering the quantity of product material delivered to the skin during each single withdrawal of the applicator from the container may now be readily understood. As the applicator begins to be withdrawn from the container after the cap is unscrewed, and before the distal end portion of the tip 22 reaches the metering orifice of the wiper 12, the wiper lip 12*b* (which defines the metering orifice) is wiping the stem 20, but the applicator tip distal end portion 28 bears an excess 40 of the product material, over and above the amount filling the concavity 32 (FIG. 13). When the distal end portion 28 of the applicator tip passes through the metering orifice of the wiper 12 (FIGS. 10 and 12), the elastic annular lip 12b contracts to engage the surface of the distal end portion 28, wiping off the excess product material 40 (FIG. 14) so that, as the distal end portion of the applicator tip completes its traverse of the wiper metering orifice (FIG. 11), the only product material still carried by the applicator tip is that contained within the reservoir or concavity 32 (FIG. 15). Thus, the amount of product material delivered to the skin is metered by the described cooperation of the wiper and the distal end portion of the applicator tip. It will be appreciated that the aforementioned physical characteristics of the wiper, as well as the shape and size of the applicator concavity 32, determine the precision of the metering action and the volume of the metered amount.

Figure 16:
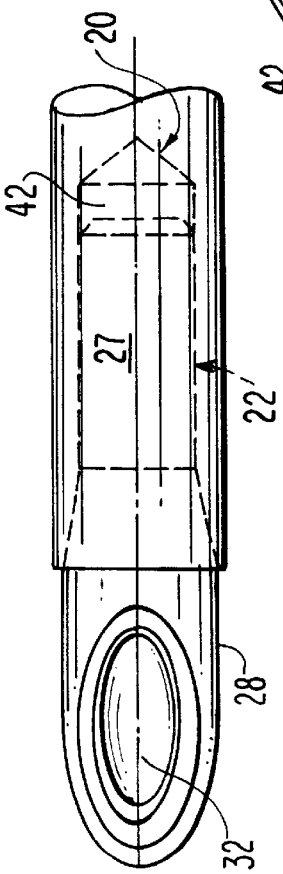
FIGS. 16 and 17 are, respectively, an enlarged fragmentary front elevational view and a further enlarged fragmentary perspective view of the applicator tip and stem of the system of FIG. 1, illustrating the manner in which the tip is mounted in the stem.
Figure 17:
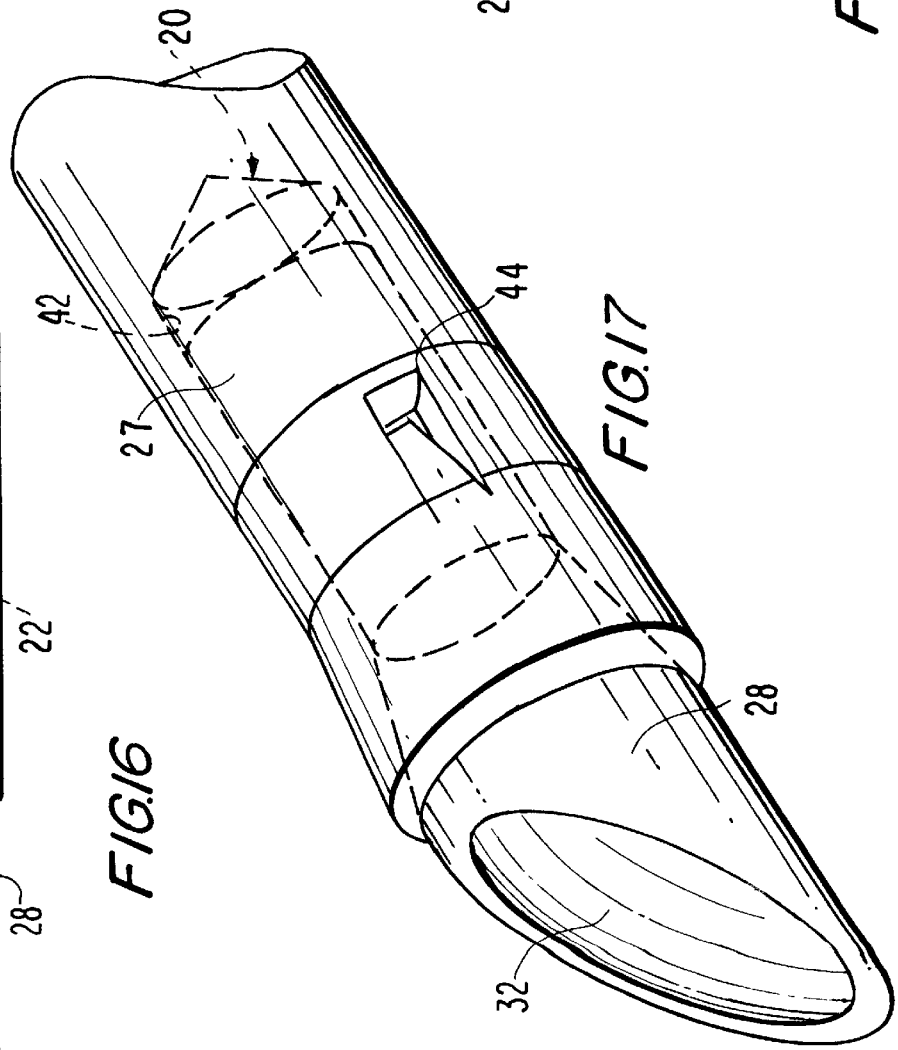

One convenient, but non-limiting, arrangement for mounting the applicator tip 22 in the stem 20 is illustrated in FIGS. 16 and 17. In this arrangement, the distal end of the stem 20 is provided with an axial recess 42 for receiving the proximal shank portion 27 of the applicator tip. The tip shank portion, when thus inserted, is held by staking as indicated at 44 at two diametrically opposed locations around the circumference of the stem.

The applicator tip can be fabricated of two or more materials having different characteristics. For instance, by the process known as bi-injection molding, the distal end portion and the shank portion can be made of materials of different durometer, using different materials (or blends of materials), with the shank portion material having a higher durometer than that of the distal end portion, as desired to best serve the respective functions of these two portions. Use of a harder material for the shank increases staking retention, affording superior security of attachment to the stem 20, while a softer material is preferred for the distal end portion which comes into contact with the user's skin.

FIGS. 18–24 illustrate several applicator tips in accordance with the invention, produced by bi-injection molding to provide shank and distal end portions of respectively different durometer, with the shank portion having the higher durometer.

Figure 18:
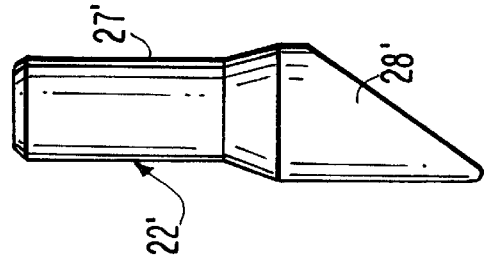
Figure 20:
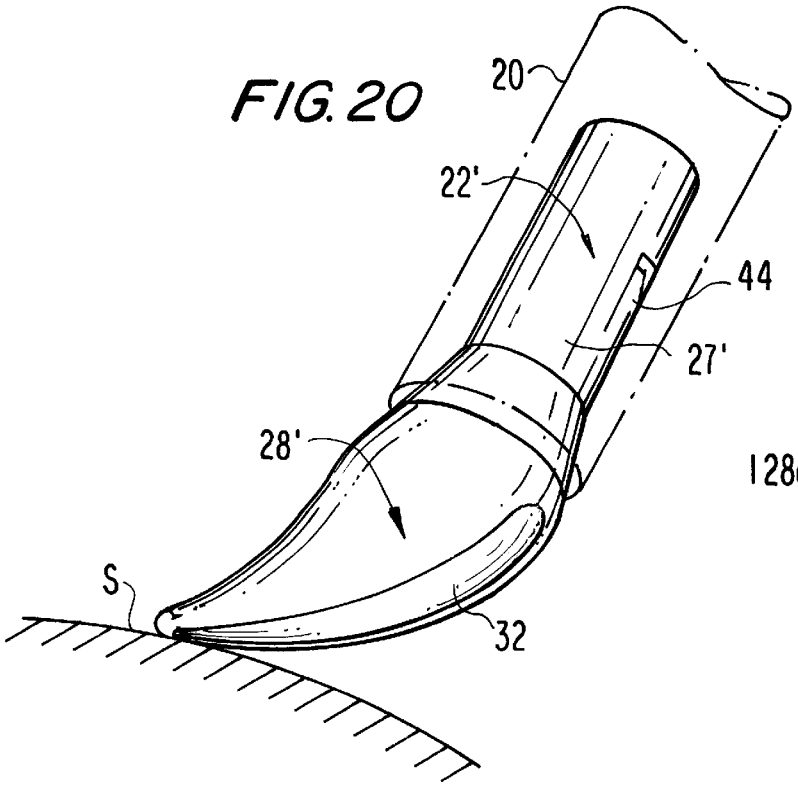
FIG. 20 is an enlarged fragmentary perspective view of the applicator tip of FIG. 18 and associated stem as the tip applies a material such as a cosmetic to a user's skin.
Figure 23:
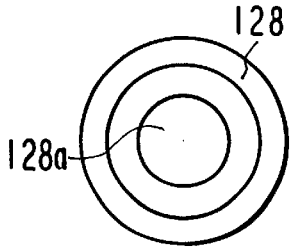
FIGS. 21–23 are, respectively, side elevational, front elevational and distal end enlarged views of another type of bi-injected molded applicator usable in the system of FIG. 1.
Figure 21:
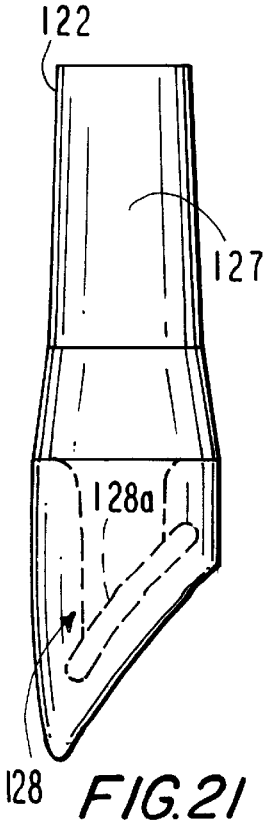
Figure 22:
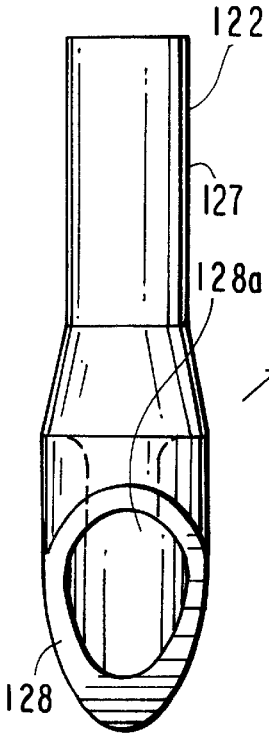
Figure 24:
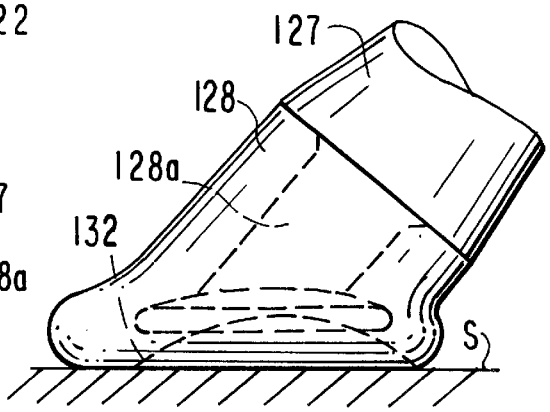
FIG. 24 is an enlarged fragmentary sectional view of the applicator tip of FIGS. 21–23 engaging a user's skin.
Figure 27:
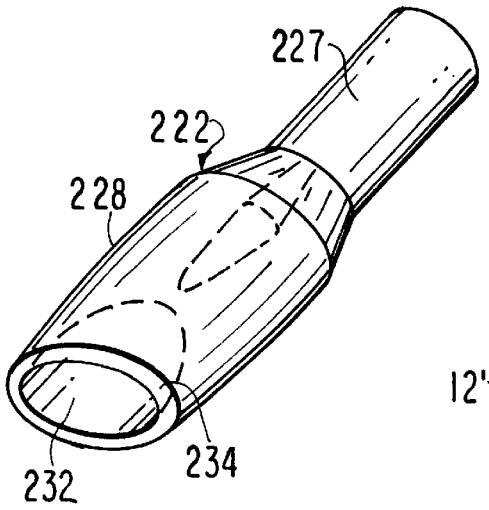
FIGS. 25–29 are, respectively, distal end, fragmentary side sectional and perspective views of another embodiment of the applicator tip, a fragmentary sectional side view of this tip in association with a wiper, and a side view of the tip applying a material such as a cosmetic to a user's skin.

In the applicator tip 22' of FIGS. 18 and 20, the shank portion 27' which is staked to the stem 20 has a relatively high durometer, while the distal end portion 28' which applies product material to a user's skin is of lower durometer, hence softer, to conform more easily to the shape of the application (skin) surface S. The transition between the higher durometer material of the shank portion and the lower durometer material of the distal end portion is sharply defined in the tip 22'. Alternatively, as indicated at 46 in FIG. 19, there can be a smooth, gradual transition between the higher durometer material of shank portion 27" and the lower durometer material of distal end portion 28".

FIGS. 21–24 illustrate a further embodiment of the applicator tip, again formed by bi-injection molding with the shank portion material having a higher diameter than that of the distal end portion. In this applicator tip, designated 122, there is again a sharp discontinuity between the shank portion 127 and the distal end portion 128. The shank portion, however, includes a distally projecting core 128*a* which is surrounded by the lower-durometer material of the distal end portion forming the cup-shaped concavity 132. The core serves to stiffen the applicator tip for more precise application while the surrounding lower durometer material of portion 128 which engages the skin application area S provides desired softness to the touch.

Figure 28:
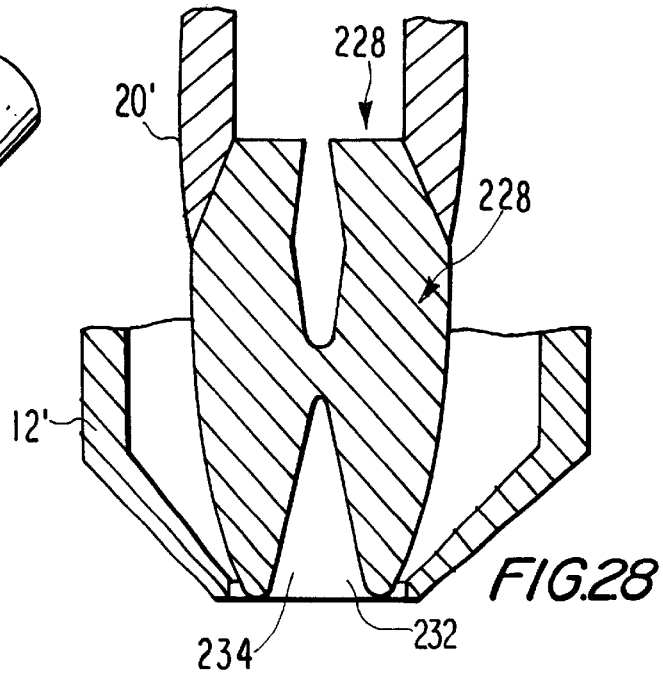
Figure 26:
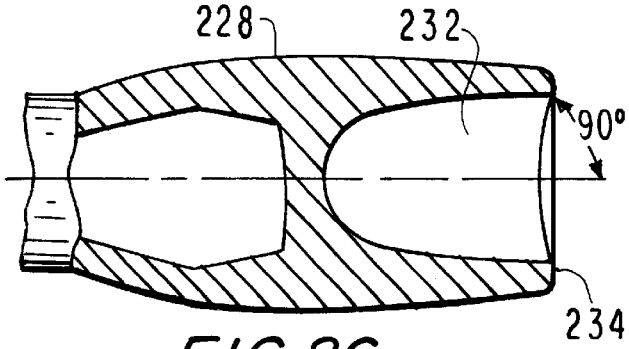
Figure 25:
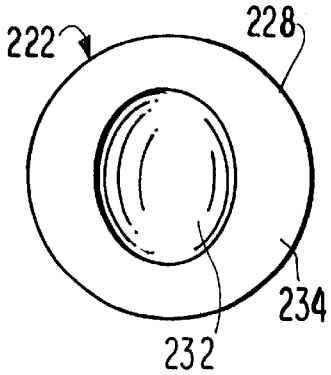
Figure 29:
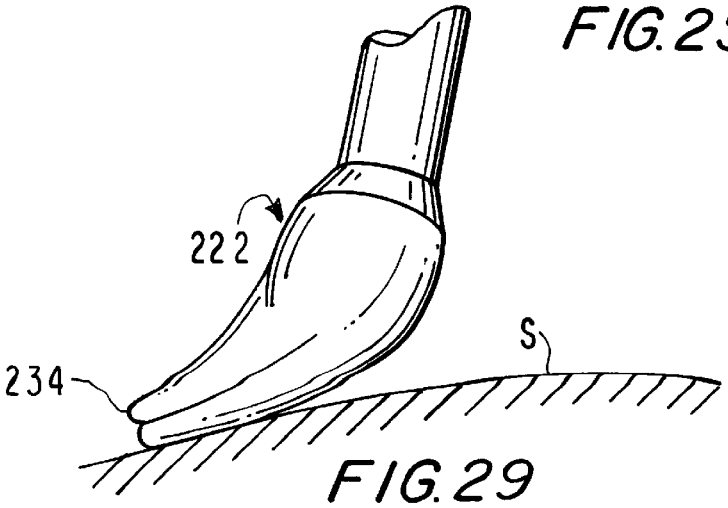
Figure 31:
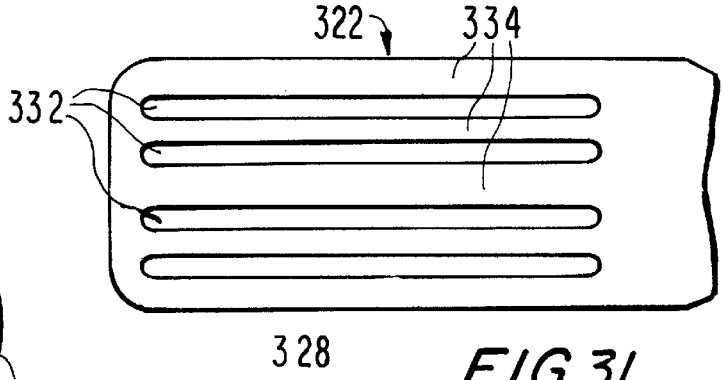
FIGS. 30–34 are, respectively, distal end, fragmentary front elevational and side elevational views of a further embodiment of the applicator tip, a perspective view showing the application of this tip to a user's skin, and a fragmentary side elevational view showing the tip pressed against the skin.
Figure 30:
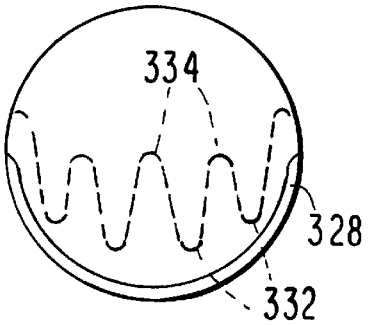
Figure 32:
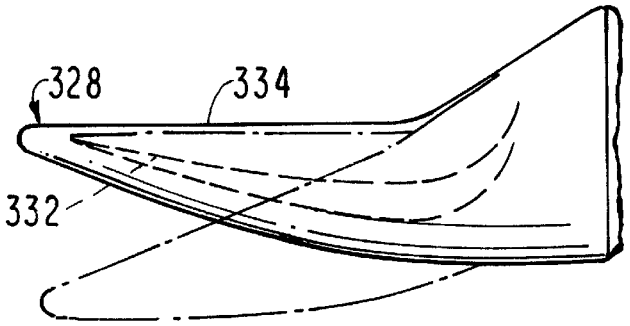

FIGS. 25–29 illustrate a further modification in which the applicator tip, designated 222, has a shank portion 227 and a distal end portion 228 with a cup-shaped concavity 232 having a continuous annular rim 234 lying in a plane perpendicular to the long axis of the applicator tip, such that angle $\alpha$ is 90°. In this embodiment, the stem is indicated at 20' and the wiper at 12' (FIG. 28). As FIG. 29 shows, when the tip is pushed against the application surface (skin surface S), the cup or cavity 232 collapses to squeeze out product onto the skin.

Figure 34:
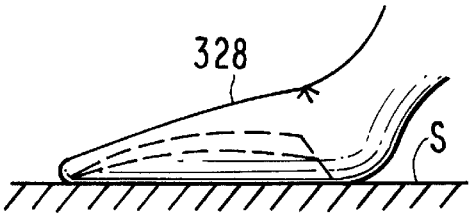
Figure 33:
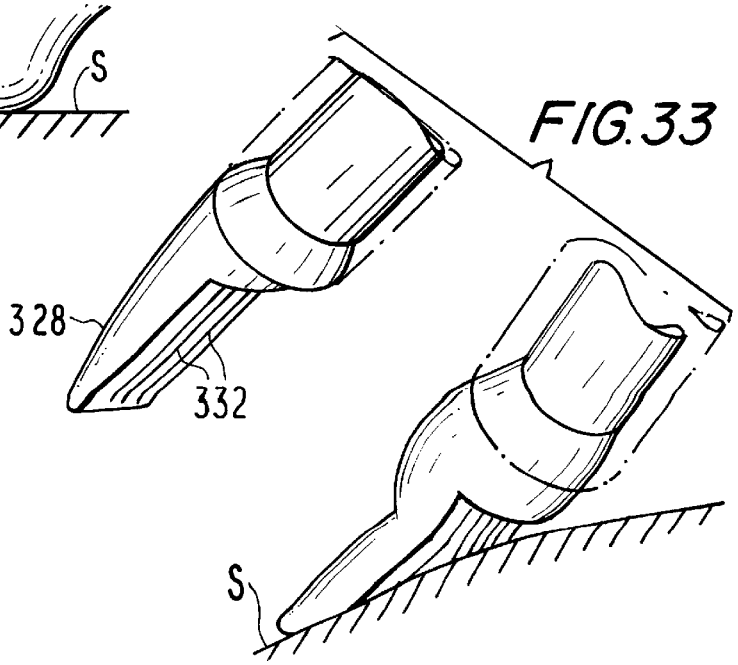

Another modified form of the applicator tip is shown at 322 in FIGS. 30–34. In this instance, the distal end portion 328 is formed with several elongated parallel cups or concavities 332 (four being shown in the drawings, although the number could be larger or smaller, e.g. 2 cups, 10 cups, etc.) having rims 334 lying substantially in a plane at an angle of 0° to the long axis of the tip 322 (i.e., $\alpha$=0°). The multiple metering cups 332 in this embodiment provide thinner reservoirs particularly suitable for low viscosity products. As shown in FIGS. 33 and 34, taken together, the distal end 328 can flex to become entirely flat against the application surface (skin surface S).

Figure 36:
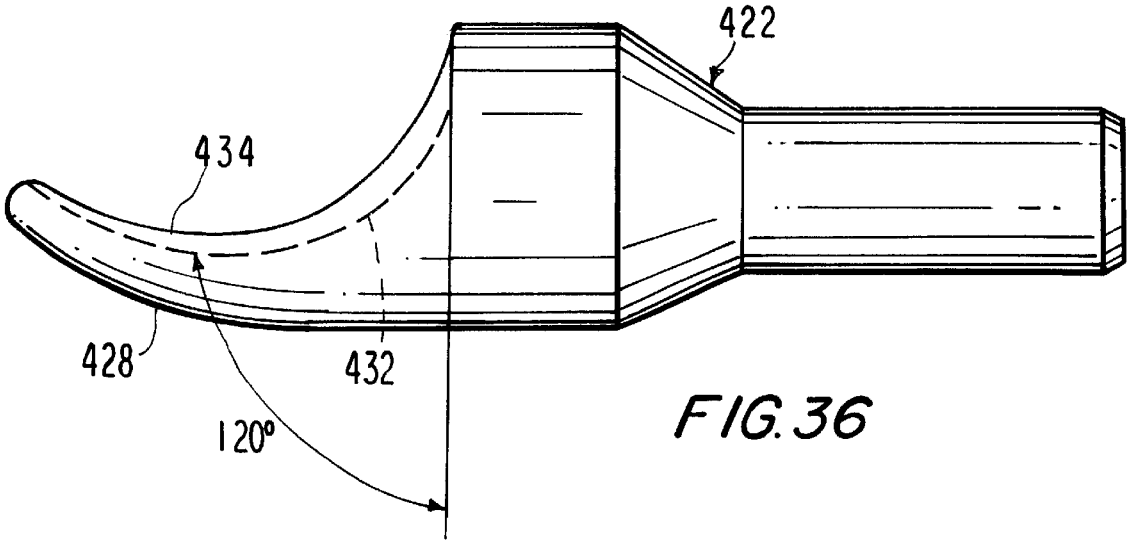
FIGS. 35 and 36 are, respectively, distal end and fragmentary side elevational views of yet another embodiment of the applicator tip.
Figure 35:
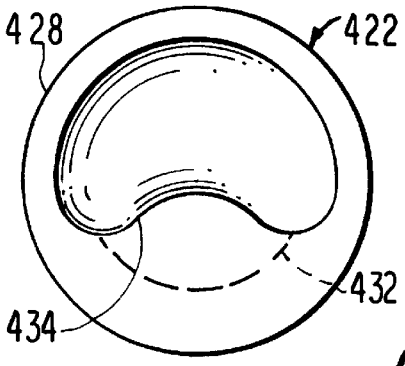

In the further modified form of applicator tip 422 illustrated in FIGS. 35 and 36, the distal end portion 428 has a concavity 432 with a rim 434 that does not lie in a single plane, but in part faces back toward the body of the applicator tip as indicated by the angle marked 120° in FIG. 36.

It is to be understood that the invention is not limited to the features and embodiments hereinabove specifically set forth, but may be carried out in other ways without departure from its spirit.

What is claimed is:

1. A container-applicator system for material to be applied to the human skin, comprising, in combination, a container for holding a body of the material, said container having an opening; a flexible wiper mounted in the opening; and an applicator insertable into and withdrawable from said container through the opening for transporting a quantity of the material from the container and applying the transported quantity of material to a user's skin, the wiper engaging the applicator to remove excess amounts of material therefrom as the applicator is withdrawn through the opening, the applicator comprising a generally cylindrical elastomeric tip with a long axis, the tip including a distal end portion having a distal extremity with at least one material-holding concavity formed therein, and said one concavity having a rim.

2. A container-applicator system for material to be applied to the human skin, comprising, in combination, a container for holding a body of the material, said container having an opening; a flexible wiper mounted in the opening; and an applicator insertable into and withdrawable from said container through the opening for transporting a quantity of the material from the container and applying the transported quantity of material to a user's skin, the wiper engaging the applicator to remove excess amounts of material therefrom as the applicator is withdrawn through the opening, the applicator comprising a generally cylindrical elastomeric tip with a long axis, the tip including a distal end portion having a distal extremity with a material holding cup-shaped concavity formed therein, and the concavity having a rim.

3. A system as defined in claim 2, wherein said rim lies substantially in a plane which is at an oblique angle to said long axis.

4. A system as defined in claim 3, wherein said wiper is a flexible annular member which engages the rim of the concavity as the applicator tip is withdrawn through the opening so as to remove any excess of said material projecting from the concavity, whereby the concavity and the wiper cooperatively meter the amount of said material transported from the container by each withdrawal of the applicator therefrom.

5. A system as defined in claim 2, wherein said rim lies substantially in a plane which is at an angle of 90° to said long axis.

6. A system as defined in claim 2, wherein said applicator tip has a proximal shank portion formed integrally with the distal end portion, and wherein said system further includes a stem having a distal opening in which said shank portion is fixedly inserted.

7. A system as defined in claim 6, wherein said shank portion is secured in said stem by staking.

8. A system as defined in claim 6, wherein said container has a neck portion in which said opening is formed, said stem has a proximal end, and said applicator further includes a cap seatable on said neck portion, said proximal end of said stem being secured to said cap such that said stem extends from said cap through said opening and into said container when said cap is seated on said neck portion.

9. A system as defined in claim 6, wherein said shank portion of said applicator tip has a higher durometer than the distal end portion, said applicator tip being formed by bi-injection molding.

10. A system as defined in claim 9, wherein said shank portion includes a distally projecting core portion surrounded by said distal end portion.

* * * * *